US009238308B2

(12) United States Patent
Toba et al.

(10) Patent No.: US 9,238,308 B2
(45) Date of Patent: Jan. 19, 2016

(54) CUTTING METHOD OF HONEYCOMB FORMED BODY

(71) Applicant: NGK Insulators, Ltd., Nagoya (JP)

(72) Inventors: Keisuke Toba, Nagoya (JP); Kensuke Okumura, Nagoya (JP); Seiichiro Hayashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 14/519,653

(22) Filed: Oct. 21, 2014

(65) Prior Publication Data

US 2015/0047622 A1 Feb. 19, 2015

Related U.S. Application Data

(63) Continuation of application No. PCT/JP2014/059249, filed on Mar. 28, 2014.

(30) Foreign Application Priority Data

Mar. 29, 2013 (JP) ..... 2013-075080

(51) Int. Cl.

| | |
|---|---|
| ***B28D 1/02*** | (2006.01) |
| ***B28D 5/04*** | (2006.01) |
| ***B28B 11/16*** | (2006.01) |
| ***B26D 7/08*** | (2006.01) |
| ***B26D 1/08*** | (2006.01) |
| ***B26D 3/16*** | (2006.01) |

(52) U.S. Cl.

CPC .. *B28D 1/02* (2013.01); *B26D 1/08* (2013.01); *B26D 3/16* (2013.01); *B26D 7/086* (2013.01); *B28B 11/163* (2013.01); *B28D 5/047* (2013.01)

(58) Field of Classification Search

CPC ..... B28D 1/02; B26D 7/08; B26D 7/086; B28B 11/16; B23D 15/00

USPC ..... 125/12, 16.01, 17; 451/165, 164, 910

See application file for complete search history.

(56) References Cited

U.S. PATENT DOCUMENTS 2,967,381 A * 1/1961 Brown ..... 451/320
3,031,804 A * 5/1962 Thatcher et al. ..... 451/37

(Continued)

FOREIGN PATENT DOCUMENTS

JP 63-067105 A1 3/1988
JP 06-155439 A1 6/1994

(Continued)

OTHER PUBLICATIONS

International Search Report and Written Opinion (Application No. PCT/JP2014/059249) dated Jun. 17, 2014.

*Primary Examiner* — Robert Rose
(74) *Attorney, Agent, or Firm* — Burr & Brown, PLLC

(57) ABSTRACT

A cutting method of a honeycomb formed body is provided. This is a cutting method of a honeycomb formed body in which, while a kneaded material containing a ceramic raw material is extruded to form a honeycomb formed body with a honeycomb shape having partition walls defining and forming a plurality of cells, the extruded honeycomb formed body is cut before drying by a cutting blade vibrated at a frequency of 0.3 kHz or more in a direction perpendicular to a direction in which this honeycomb formed body moves. It is preferably a cutting method of a honeycomb formed body in which the cutting blade is vibrated at a high frequency of 10 kHz or more.

12 Claims, 2 Drawing Sheets

(56) References Cited

U.S. PATENT DOCUMENTS

| | | | | |
|---|---|---|---|---|
| 4,702,138 | A * | 10/1987 | Hattori et al. | 83/785 |
| 5,228,372 | A * | 7/1993 | Harrop et al. | 83/13 |
| 5,768,970 | A * | 6/1998 | Wolf et al. | 83/701 |
| 6,520,061 | B2 * | 2/2003 | Fukuta et al. | 83/651.1 |
| 6,711,979 | B1 * | 3/2004 | Miyakawa et al. | 83/862 |
| 6,994,816 | B2 * | 2/2006 | Ishii et al. | 264/150 |

FOREIGN PATENT DOCUMENTS

| | | | |
|---|---|---|---|
| JP | 10-175205 | A1 | 6/1998 |
| JP | 2001-001330 | A1 | 1/2001 |
| JP | 2001-096524 | A1 | 4/2001 |
| JP | 2004-314244 | A1 | 11/2004 |
| JP | 2010-214781 | A1 | 9/2010 |

* cited by examiner

CUTTING METHOD OF HONEYCOMB FORMED BODY

TECHNICAL FIELD

The present invention relates to a cutting method of a honeycomb formed body. In more detail, the present invention relates to a cutting method of a honeycomb formed body in which a shape of a cell on an end face of the honeycomb formed body after cutting is favorable, and the honeycomb formed body after cutting can be obtained efficiently.

BACKGROUND ART

Conventionally, as a carrier for carrying a catalyst for purifying an exhaust gas exhausted from an engine of an automobile or the like, a ceramic honeycomb structure (honeycomb structure) having partition walls for defining and forming a plurality of cells extending from one end face to the other end face is used. This honeycomb structure is produced by drying and firing a honeycomb formed body made of a kneaded material containing a ceramic raw material. Then, this honeycomb formed body is obtained by continuously extruding the kneaded material so as to have a honeycomb shape while sequentially cutting the same to an appropriate length.

As a method of sequentially cutting the honeycomb formed body having a honeycomb shape continuously extruded into an appropriate length, a cutting method of a honeycomb formed body by using a thin steel wire (hereinafter referred to simply as a "steel wire") is generally used. When this steel wire is used, in an initial stage in which this steel wire cuts into the honeycomb formed body, deformation of the honeycomb formed body occurs, and a degree of this deformation is large. Thus, a cutting method that, at a portion in the honeycomb formed body where cutting is to be started, a cut line is made by a knife-shape tool in advance in a direction orthogonal to a direction in which the cell extends, and the steel wire is made to enter this cut line and to cut the honeycomb formed body (see Patent Literature 1, for example) is used in some cases. A method of cutting while vibrating the steel wire in a length direction of the steel wire is also known (see Patent Literature 2, for example).

CITATION LIST

Patent Documents

[Patent Document 1] JP-A-2001-96524
[Patent Document 2] JP-A-S63-67105

SUMMARY OF THE INVENTION

Problem to be Solved by the Invention

The cutting method described in Patent Literature 1 is to make a cut line in advance by a knife-shape tool at a portion of the honeycomb formed body where cutting is to be started and to allow the steel wire to enter this cut line. That is because, when cutting is performed by using a steel wire, in an initial stage of cutting in which the steel wire is brought into contact with the honeycomb formed body and starts entering into the honeycomb formed body, deformation of cells of the honeycomb formed body becomes large. The cut line is usually substantially equal to a thickness of a circumferential peripheral wall or to a depth for several cells more at the deepest. If the knife-shape tool is inserted too deep, deformation of the cell can be easily caused. The cutting method by making a cut line by a knife-shape tool in advance is effective in reducing deformation of cells in a cut surface caused in the initial cutting, but since a process of making a cut line with the tool is needed, the number of processes increases. Moreover, it does not contribute to deformation of cells caused by cutting other than the initial cutting. The cutting method described in Patent Literature 2 cuts the honeycomb formed body while applying vibration to the steel wire, and thus, the honeycomb formed body can be cut more favorably. That is, in cutting of the honeycomb formed body, deformation of cells in a cut surface of a honeycomb formed body can be reduced by a force applied to the honeycomb formed body from the steel wire.

However, in the cutting methods described in Patent Literatures 1 and 2, the steel wire is often broken in a short period of time. If the steel wire is broken, it is necessary to stop extrusion and cutting works of the honeycomb formed body and to install a new steel wire, and time and effort are required for installing the new steel wire. Moreover, stop of a continuous extrusion work gives a bad influence on a quality of the honeycomb formed body.

The partition wall defining and forming the cells of the honeycomb formed body is extremely thin and soft and thus, the cells of the honeycomb formed body are deformed by a force applied to the honeycomb formed body from the steel wire. This deformation is not limited in the cut surface but extends to the inside of the honeycomb formed body. Deformation of cells not only deteriorates mechanical strength as the honeycomb structure but may also cause a problem of closure of the cells by slurry for catalyst when the catalyst is carried. In order to prevent these defects, in the honeycomb formed body, the deformed portions (defective portions) are removed after drying by cutting both end portions including the cut surfaces. If the degree of deformation is large, an influence extending to the inside of the honeycomb formed body is also large, and more parts of the both end portions need to be cut and removed.

In continuous extrusion, in order to maintain a structure given to the honeycomb formed body by an extrusion die, ambient air needs to be supplied into each cell from the cut surface of the honeycomb formed body. A cell to which ambient air is not supplied is crushed by an atmospheric pressure. If a degree of deformations of the cell is large and the cell is closed, the ambient air is not supplied into the cell closed in the cut surface and thus, the cell is crushed over the entire length in a process of extrusion. If the cell is crushed over the entire length, the defective portion cannot be removed by cutting the both end portions as described above. Therefore, such large deformation that closes the cell extremely lowers the yield of the honeycomb formed body.

A catalyst carrier used for purification of an exhaust gas of an automobile has been developed so that the partition wall is thinned and a cell density is increased in order to improve catalyst performances. On the other hand, by thinning the partition wall, in the honeycomb formed body, the cell is likely to deform during cutting, and the increase of the cell density causes occurrence of deformation of a cell, and closure of cells is likely to occur. Thus, development of a cutting method has been demanded which can reduce deformation of a cut surface of the honeycomb formed body occurring during cutting and also reduce a stop frequency of the extrusion/cutting work without lowering an extrusion speed of the honeycomb formed body and a cutting speed of the honeycomb formed body.

The present invention was made in view of the problems of the prior arts. The present invention has an object to provide a cutting method of a honeycomb formed body which has less deformation of cells in a cut surface of the honeycomb formed body after cutting (honeycomb formed body cut product) and can improve production efficiency.

Means for Solving the Problem

According to the present invention, a cutting method of a honeycomb formed body illustrated below is provided.

According to a first aspect of the present invention, a cutting method of a honeycomb formed body is provided, in which, while a kneaded material containing a ceramic raw material is extruded to form a honeycomb formed body with a honeycomb shape having partition walls defining and forming a plurality of cells, the extruded honeycomb formed body is cut before drying by a cutting blade vibrated at a frequency of 0.3 kHz or more in a direction perpendicular to a direction in which the honeycomb formed body moves.

According to a second aspect of the present invention, the cutting method of a honeycomb formed body according to the first aspect is provided, in which the cutting blade is vibrated at a high frequency of 10 kHz or more.

According to a third aspect of the present invention, the cutting method of a honeycomb formed body according to the first or second aspect is provided, in which the cutting blade is vibrated with amplitude of vibration at 15 to 40 μm in the direction perpendicular to the direction in which the honeycomb formed body moves.

According to a fourth aspect of the present invention, the cutting method of a honeycomb formed body according to any one of the first through third aspects is provided, in which a thickness of the cutting blade is 0.6 mm or less.

According to a fifth aspect of the present invention, the cutting method of a honeycomb formed body according to any one of the first through fourth aspects of the present invention is provided, in which vertical vibration which is vibration in a direction perpendicular to a direction in which the honeycomb formed body moves, and lateral vibration which is vibration in a direction in parallel with the direction in which the honeycomb formed body moves are included; and the cutting blade is vibrated with amplitude of the lateral vibration at 30 μm or more.

According to a sixth aspect of the present invention, the cutting method of a honeycomb formed body according to any one of the first through fifth aspects is provided, in which a width of the cutting blade is 5 to 30 mm.

According to a seventh aspect of the present invention, the cutting method of a honeycomb formed body according to any one of the first through sixth aspects is provided, in which the cutting blade is vibrated at an output of 50 W or more.

According to an eighth aspect of the present invention, the cutting method of a honeycomb formed body according to any one of the first through seventh aspects is provided, in which, while the kneaded material is extruded in a horizontal direction to form the honeycomb formed body, the extruded honeycomb formed body is cut so that a section in a direction orthogonal to a direction in which the cells of the honeycomb formed body extend is formed by the cutting blade.

According to a ninth aspect of the present invention, the cutting method of a honeycomb formed body according to any one of the first through eighth aspects is provided, wherein a component of a moving speed of the cutting blade in a direction orthogonal to the direction in which the cells of the honeycomb formed body extend is 10 to 100 mm/second.

According to a tenth aspect of the present invention, the cutting method of a honeycomb formed body according to any one of the first through ninth aspects is provided, wherein an extrusion speed of the honeycomb formed body and a component of a moving speed of the cutting blade in a direction in parallel with the direction in which the cells of the honeycomb formed body extend are equal.

According to an eleventh aspect of the present invention, the cutting method of a honeycomb formed body according to any one of the first through tenth aspects is provided, in which a thickness of the partition walls of the honeycomb formed body are 50 to 300 μm.

According to a twelfth aspect of the present invention, the cutting method of a honeycomb formed body according to any one of the first through eleventh aspects is provided, in which as the cutting blade, a cutting blade of a material of stainless steel, quenched stainless steel or carbon steel is used.

According to a thirteenth aspect of the present invention, the cutting method of a honeycomb formed body according to any one of the first through twelfth aspects is provided, in which both end portions of the cutting blade are supported by a support member connected to a vibrator generating vibration at a frequency of 0.3 kHz or more.

Effect of the Invention

The cutting method of a honeycomb formed body of the present invention is a method in which, while a kneaded material containing a ceramic raw material is extruded to form a honeycomb formed body having a honeycomb shape, this honeycomb formed body is cut before drying by a cutting blade vibrated at a frequency of 0.3 kHz or more in a direction perpendicular to a direction in which the honeycomb formed body moves. As described above, according to the cutting method of the honeycomb formed body of the present invention, since the honeycomb formed body is cut by the cutting blade vibrated at the predetermined frequency or more in the direction perpendicular to the direction in which the honeycomb formed body moves, deformation of cells in a cut surface of the honeycomb formed body after cutting can be reduced. Moreover, production efficiency of an extrusion/cutting process can be improved. Specifically, by using the cutting blade instead of a steel wire as a cutting means of the honeycomb formed body, the cutting means can be prevented from being broken in a short period of time. Thus, time and effort are not required for replacing the cutting means in a short period of time. That is, if the cutting blade is used, a situation in which the cutting work of the honeycomb formed body should be stopped in order to replace unexpectedly broken cutting edge does not occur in a short period of time. Thus, according to the cutting method of the honeycomb formed body of the present invention, a honeycomb formed body cut product can be obtained efficiently. Moreover, since a process of making a cut line in advance by a knife-shape tool as described in Patent Literature 1 is not needed, the cutting process can be simplified. Furthermore, since a frequency in which cutting facilities stop is reduced, improvement in a quality of the honeycomb formed body can be expected.

DETAILED DESCRIPTION OF THE INVENTION

Figure 1:
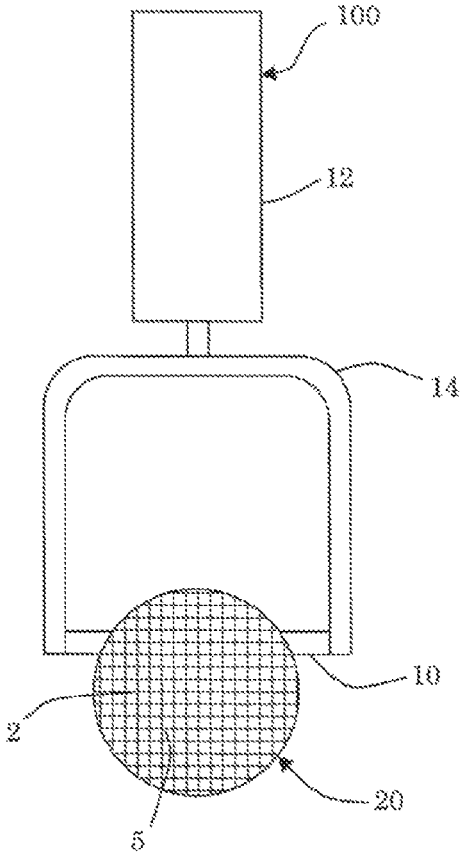
FIG. 1 is a front view schematically illustrating a state in which a honeycomb formed body is cut according to an embodiment of a cutting method of a honeycomb formed body of the present invention.

An embodiment of the present invention will be explained below. The present invention is not limited to the embodiment below but it should be understood that those with changes, improvements and the like added as appropriate to the embodiment below on the basis of common knowledge of those skilled in the art within a scope not departing from the gist of the present invention are also included in the scope of the present invention.

[1] Cutting Method of Honeycomb Formed Body:

In a cutting method of a honeycomb formed body of the present invention, while a kneaded material containing a ceramic raw material is extruded to form a honeycomb formed body having a honeycomb shape, this honeycomb formed body is cut before drying by a cutting blade vibrated at a frequency of 0.3 kHz or more in a direction perpendicular to a direction in which the honeycomb formed body moves. The honeycomb formed body having a honeycomb shape has partition walls defining and forming a plurality of cells. The cutting method of a honeycomb formed body of the present invention basically uses a principle in which the cutting blade is vibrated at a predetermined frequency or more in a cutting direction (an orthogonal direction which will be described later), and the slightly vibrating cutting blade enters the honeycomb formed body and cuts the honeycomb formed body. The above-described "cutting direction" can be referred to as a direction perpendicular to a direction in which the honeycomb formed body moves.

In the cutting method of a honeycomb formed body of the present invention, moreover, the honeycomb formed body can be favorably cut by vibration (lateral vibration) also in the direction perpendicular to the cutting direction. That is, the lateral vibration is considered to have a role of separating the cut surfaces away and is considered to perform favorable cutting by reducing friction in cutting.

In the cutting method of a honeycomb formed body of the present invention, the honeycomb formed body having been extruded as described above is preferably cut by a cutting blade vibrated at a high frequency in the direction perpendicular to the direction in which the honeycomb formed body moves. By performing as above, cells of the honeycomb formed body can be reliably prevented from being crushed. In this Specification, the "high-frequency vibration" refers to vibration at a frequency of 10 kHz or more. In "Supersonic Engineering—Theory and Practice" (Kogyo Chosakai Publishing Co. Ltd.) by Masanori Shimakawa, the "high frequency" is said to be 10 kHz to 1 MHz.

In the cutting method of a honeycomb formed body of the present invention, while the kneaded material containing a ceramic raw material is extruded to form a honeycomb formed body having a honeycomb shape as described above, this honeycomb formed body is cut by the cutting blade vibrated at the predetermined frequency or more in the direction perpendicular to the direction in which the honeycomb formed body moves. Thus, according to the cutting method of a honeycomb formed body of the present invention, deformation of cells in the cut surface of the honeycomb formed body after cutting can be reduced. As a result, a cutting margin on both end faces after drying can be reduced or the cutting margin can be eliminated. Moreover, by preventing the cells from being crushed over the entire length of the honeycomb formed body, yield of the honeycomb formed body can be also improved.

Figure 2:
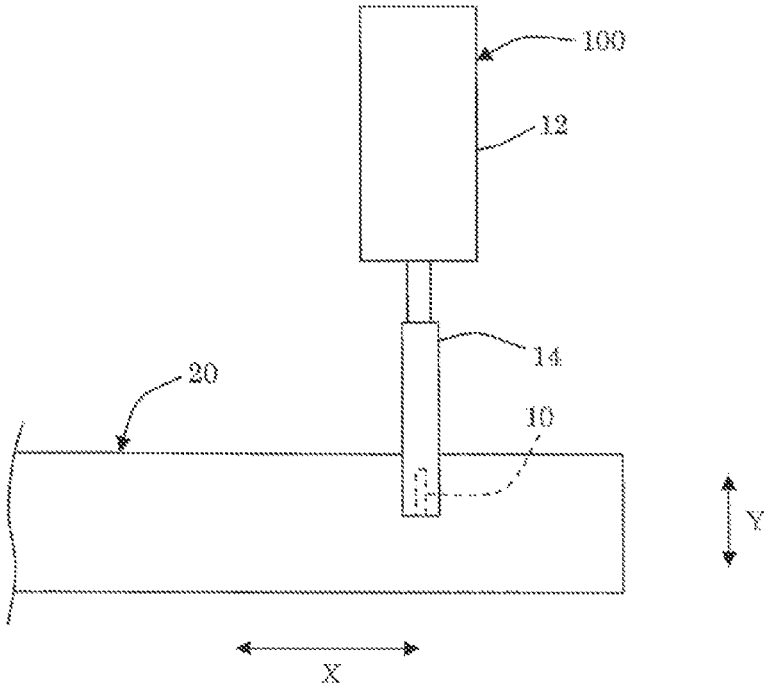
FIG. 2 is a side view schematically illustrating a state in which the honeycomb formed body is cut according to the embodiment of the cutting method of a honeycomb formed body of the present invention.

In the cutting method of a honeycomb formed body of the present invention, as long as the honeycomb formed body after cutting has a honeycomb shape having partition walls defining and forming a plurality of cells extending from one end face to the other end face, the honeycomb formed body can be cut in any direction. In the cutting method of a honeycomb formed body of the present invention, it is preferable that the honeycomb formed body is cut as described below. That is, while the kneaded material is extruded in the horizontal direction and the honeycomb formed body extending in an extrusion direction (horizontal direction) is formed, this honeycomb formed body is preferably cut by the cutting blade along a direction orthogonal to the direction in which the cells of the honeycomb formed body extend (see FIGS. 1 and 2). Cutting the honeycomb formed body "along the direction orthogonal to the direction in which the cells of the honeycomb formed body extend" means that the honeycomb formed body is cut so that a section in the direction orthogonal to the direction in which the cells of this honeycomb formed body extend is formed. By cutting the honeycomb formed body in this way, a shape of the cut surface of the honeycomb formed body after cutting becomes more favorable. FIG. 1 is a front view schematically illustrating a state in which the honeycomb formed body is cut according to an embodiment of the cutting method of a honeycomb formed body of the present invention. FIG. 2 is a side view schematically illustrating a state in which the honeycomb formed body is cut according to the embodiment of the cutting method of a honeycomb formed body of the present invention.

In the cutting method of a honeycomb formed body of the present invention, the cutting blade cuts the honeycomb formed body while moving in accordance with a moving speed (extrusion speed of the honeycomb formed body) of the honeycomb formed body moving in the direction in which the cells extend. Thus, the moving speed of the cutting blade is a composite speed of a "component in a direction orthogonal to the direction in which the cells of the honeycomb formed body extend" and a "component in a direction in which the cells of the honeycomb formed body extend".

The "component in the direction orthogonal to the direction in which the cells of the honeycomb formed body extend (moving speed component)" in the moving speed of the cutting blade is preferably set to 10 to 100 mm/sec. Moreover, it is more preferably set to 30 to 70 mm/sec. By setting the moving speed component of the cutting blade within the above-described range, the honeycomb formed body can be cut more efficiently. That is, time required for cutting the honeycomb formed body to obtain the honeycomb formed body cut product can be set appropriately. Thus, by employing the cutting method of a honeycomb formed body of the present invention for a manufacturing process of a "honeycomb structure which is an end product", production efficiency of the "honeycomb structure which is an end product" is further improved. If the moving speed component is less than the above-described lower limit value, the cutting blade closes open ends of the cells, and there is a concern that the cells are crushed by an atmospheric air. If the above-described upper limit value is exceeded, an impact at cutting increases, and there is a concern that the cells are crushed. The moving speed component is as described above, but a "component of the moving speed of the cutting blade in the direction in which the cells of the honeycomb formed body extend" is preferably set equal to the extrusion speed of the honeycomb formed body. That is because the honeycomb formed body cut product having a cut surface orthogonal to the cell extending direction can be obtained.

The extrusion speed of the honeycomb formed body and a "component in a direction in parallel with the direction in which the cells of the honeycomb formed body extend" of the moving speed of the cutting blade are preferably equal to each other. By configuring as above, the honeycomb formed body can be cut under a condition in which the cell is difficult to be closed by the cutting blade and thus, crush of the cell by the atmospheric pressure and deformation of the cutting blade become difficult to occur. The extrusion speed of the honeycomb formed body is usually 10 to 100 mm/sec.

[1-1] Honeycomb Formed Body:

The honeycomb formed body is formed by extruding the kneaded material containing the ceramic raw material and shaping it into a honeycomb shape having partition walls defining and forming a plurality of cells. That is, in the cutting method of a honeycomb formed body of the present invention, the kneaded material filled in an extruder, for example, is extruded through an extruder die, and a honeycomb formed body in a state extruded from the extruder and extending is cut by the cutting blade. The honeycomb formed body is soft. Hardness before becoming the honeycomb formed body (kneaded material hardness) is approximately 1.0 to 2.0 kgf. The kneaded material hardness is a value measured by a rheometer.

The kneaded material contains the ceramic raw material as described above, and examples of this ceramic raw material include alumina, kaolin, talc and the like.

As the kneaded material, those containing water, a binder and the like other than the ceramic raw material can be used.

The honeycomb formed body can be the one with a thickness of partition walls of 50 to 300 μm. According to the cutting method of a honeycomb formed body of the present invention, favorable cutting can be made even if the thickness of the partition walls is within the above-described range. That is, if the thin honeycomb formed body made of the above-described kneaded material and having the thickness of the partition walls as in the above-described range is cut in the prior art cutting method, the thin partition walls are deformed during cutting (that is, the cells are crushed) in some cases. On the other hand, by means of the cutting method of a honeycomb formed body of the present invention, the partition walls of the honeycomb formed body can be prevented from being deformed. That is, the cells can be prevented from being crushed during cutting the honeycomb formed body.

The honeycomb formed body can have a cell density of 50 to 200 cells/cm$^2$. According to the cutting method of a honeycomb formed body of the present invention, the honeycomb formed body having the cell density in the above-described range can be cut favorably without crushing the cell.

The shape of the honeycomb formed body is not particularly limited and can be circular columnar, elliptic columnar, polygonal columnar and the like.

[1-2] Cutting Blade:

The cutting blade is distinguished from the steel wire as the above-described cutting means. A shape of this cutting blade is not particularly limited but preferably has a plate shape which is elongated in one direction (longitudinal direction) (see FIGS. 1 and 2). By using the cutting blade like this, the shape of the cells on an end face of the honeycomb formed body after cutting is made favorable. Moreover, the honeycomb formed body after cutting can be efficiently obtained, and furthermore, yield of the raw material can be improved.

A thickness of the cutting blade is preferably 0.6 mm or less, more preferably 0.25 to 0.50 mm, and particularly preferably 0.30 to 0.40 mm. If the thickness of the cutting blade is within the above-described range, the honeycomb formed body can be cut without crushing the cells. If the thickness of the cutting blade is less than the lower limit value, the cutting blade can be easily broken, and there is a concern that a frequency of stop of the cutting facility of the honeycomb formed body increases. If the upper limit value is exceeded, cutting resistance of the honeycomb formed body increases, and there is a concern that the cells are deformed. The "thickness of the cutting blade" is a length in a direction orthogonal to the longitudinal direction of a portion in which the cutting blade is in contact with the honeycomb formed body when the cutting blade is stood on the honeycomb formed body in order to cut the honeycomb formed body.

A width of the cutting blade is preferably 5 to 30 mm. If the width of the cutting blade is within the above-described range, the honeycomb formed body can be cut without crushing the cells. If the width of the cutting blade is less than the lower limit value, lateral shifting of the cutting blade increases, and there is a concern that cutting accuracy deteriorates. If the upper limit value is not reached, a contact area between the cutting blade and the honeycomb formed body increases, and there is a concern that the cells are deformed. The "width of the cutting blade" is a maximum length from the blade to the ridge of the cutting blade.

Regarding the length of the cutting blade, if the honeycomb formed body has a circular columnar shape, there is no particular limitation as long as it is longer than a diameter of the end face of the honeycomb formed body. Specifically, the length of the cutting blade can be 200 to 300 mm.

A material of the cutting blade is preferably a material with high strength and excellent abrasion resistance. The material of the cutting blade can be specifically stainless steel (SUS), quenched stainless steel, carbon steel and the like, and such a material can withstand vibration to be applied for a long time. It is to be noted that the "quenched stainless steel" means quenched stainless steel and specifically means a stainless steel obtained by holding stainless steel at a temperature of a transformation point or above and then, by applying rapid quenching processing.

A shape of an edge of the cutting blade can be double-edged, single-edged, saw blade or the like, for example.

The cutting blade can be supported by a support member connected to a vibrator generating vibration at a frequency of 0.3 kHz or more (double-supported cutting blade) on both end portions. Alternatively, the cutting blade may be such that one end portion is supported by the support member and the other end portion is a free end, and the support member is connected to the vibrator (cantilever cutting blade). The cutting blade is preferably the above-described "double-supported cutting blade". In the case of the double-supported cutting blade, vibration of the cutting blade is made stable in one direction, whereby cutting can be performed so that the shape of the cut surface of the honeycomb formed body is made more favorable.

Figure 3:
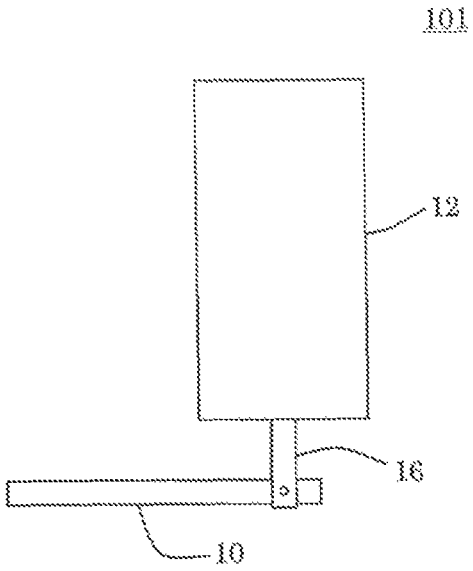
FIG. 3 is a front view schematically illustrating a cutting device used in another embodiment of the cutting method of a honeycomb formed body of the present invention.

FIGS. 1 and 2 illustrate a state in which the honeycomb formed body 20 is cut by using a cutting device 100 provided with the double-supported cutting blade 10. FIG. 3 illustrates a cutting device 101 provided with the cantilever cutting blade 10. FIG. 3 is a front view schematically illustrating the cutting device used in another embodiment of the cutting method of the honeycomb formed body of the present invention.

Examples of a cutting device used in the cutting method of a honeycomb formed body of the present invention include the cutting device 100 illustrated in FIG. 1 as described above and a cutting device 101 illustrated in FIG. 3.

The cutting device 100 illustrated in FIG. 1 includes a cutting portion body 12 provided with a vibrator (not shown) generating vibration at a frequency of 0.3 kHz or more (high-frequency vibration, for example), a first support member 14 connected to this vibrator, and a cutting blade 10 having both end portions supported by this first support member 14. The first support member 14 holds and supports the cutting blade 10 so that the cutting blade 10 does not move.

FIG. 1 illustrates a state in which, while the kneaded material is extruded in a horizontal direction X (see FIG. 2) and a honeycomb formed body 20 extending in the horizontal direction X is formed, the honeycomb formed body 20 is cut by the cutting blade 10. The honeycomb formed body 20 has a honeycomb shape with partition walls 5 defining and forming a plurality of cells 2. The cutting blade 10 vibrates with a high frequency in a direction Y (see FIG. 2) orthogonal to a direction in which the cells 2 of the honeycomb formed body 20 extend. The cutting blade 10 cuts the honeycomb formed body 20 along the direction Y (see FIG. 2) orthogonal to the direction in which the cells 2 of the honeycomb formed body 20 extend.

The cutting device 101 illustrated in FIG. 3 includes the cutting portion body 12 provided with a vibrator generating vibration at a frequency of 0.3 kHz or more (high-frequency vibration, for example), a second support member 16 connected to this vibrator, and a cutting blade 10 having one end portion supported by this second support member 16 and the other end portion is a free end. The second support member 16 holds and supports the cutting blade 10 so that the cutting blade 10 does not move.

[1-3] Vibration at Frequency of 0.3 kHz or More:

In the cutting method of a honeycomb formed body of the present invention, the cutting blade is vibrated at a frequency of 0.3 kHz or more. By cutting the honeycomb formed body while the cutting blade is vibrated at a predetermined frequency or more as described above, the shape of the cells in the end face of the honeycomb formed body after cutting is made favorable.

In the cutting method of a honeycomb formed body of the present invention, the cutting blade is preferably vibrated at a high frequency. A condition of the high-frequency vibration is that the frequency is 10 kHz or more, preferably 20 to 40 kHz, and more preferably 20 to 30 kHz. If the frequency is less than the lower limit value, cutting resistance increases, and there is a concern that the cells in the end face of the honeycomb formed body may be crushed. The frequency of the cutting blade becomes equal to the frequency of vibration applied to the cutting blade (excitation frequency).

A condition of vibration of the cutting blade is that amplitude of the vibration in a direction perpendicular to the direction in which the honeycomb formed body moves is preferably 15 to 40 μm. If the amplitude is less than the lower limit value, there is a concern that the cell is deformed in cutting. If the amplitude exceeds the upper limit value, distortion of the cutting blade increases, and there is a concern that a breakage frequency increases.

A direction orthogonal to the direction in which the cells of the honeycomb formed body extend in an advance direction of the cutting blade is assumed to be an "orthogonal direction". To the cutting blade, vibration only in the orthogonal direction (in other words, the direction perpendicular to the direction in which the honeycomb formed body moves) is usually applied, but vibration applied to the cutting blade (vibration condition of the cutting blade) can be vibration having vibration in a direction in parallel with the above-described orthogonal direction (lateral vibration), for example. That is, the above-described cutting blade may vibrate with vibration having vibration A in the direction in parallel with the above-described orthogonal direction and vibration B in another direction other than this vibration A (composite vibration). In the cutting method of the honeycomb formed body of the present invention, the above-described cutting blade may vibrate with the above-described composite vibration but preferably is vibration composed of the vibration in the direction in parallel with the above-described orthogonal direction and not having the vibration in another direction (except the above-described lateral vibration). As described above, vibration having the lateral vibration (also referred to as "back and forth vibration") other than the vibration in parallel with the orthogonal direction (vertical vibration) can cut the honeycomb formed body favorably.

In the case of vibration including the vertical vibration (vibration in the direction perpendicular to the direction in which the honeycomb formed body moves) and the lateral vibration (vibration in the direction in parallel with the direction in which the honeycomb formed body moves) (that is, if the cutting blade performs such composite vibration), amplitude of the lateral vibration is preferably 30 μm or more. By employing such a configuration, the honeycomb formed body can be cut more preferably.

A vibration condition of the cutting blade preferably has an output of 50 W or more, more preferably 50 to 500 W, particularly preferably 90 to 300 W, and most preferably 100 to 150 W. If the above-described output is less than the lower limit value, the vibration is attenuated by the cutting resistance, and there is a concern that the cells in the end face of the honeycomb formed body are crushed. If 500 W is exceeded, the vibration is too strong, and there is a concern that the cutting blade is broken.

EXAMPLES

The present invention will be explained specifically on the basis of Examples below, but the present invention is not limited to these Examples.

Example 1

First, a kneaded material including a ceramic raw material containing 20 mass % of alumina, 40 mass % of kaolin, and 40 mass % of talc; 30 mass parts of water; and 3 mass parts of a binder with respect to this ceramic raw material was prepared. Subsequently, this kneaded material was extruded and formed into a honeycomb shape having partition walls defining and forming a plurality of cells by using an extruder. An extrusion speed of the kneaded material in the extruder was 50 mm/sec. Moreover, the honeycomb formed body had a thickness of the partition wall of 75 μm. This honeycomb formed body had a hexagonal shape of cells (cell shape) in a section orthogonal to a direction in which the cell extends and had a cell density of 93 cells/cm$^2$. The hexagonal cell is difficult to be crushed, and this honeycomb formed body is a thin wall product since check is to be made in the honeycomb formed body with a partition wall not forming a straight line. The honeycomb formed body was extruded from the extruder in the horizontal direction and then, conveyed in the horizontal direction. Then, the honeycomb formed body in a state extruded from the extruder was sequentially cut by a cutting blade having a width of 18 mm, a thickness of 0.5 mm, and a length of 300 mm so as to obtain a predetermined length. As the cutting blade, a "double-supported" one supported by the support member on the both end portions, with the support member connected to the vibrator (see FIG. 1) was used. Moreover, this cutting blade had an edge shape of "double-edged". When the honeycomb formed body is cut, the frequency of vibration applied to the cutting blade (excitation frequency) was 0.4 kHz, and the output (excitation output) was 10 W. In this way, the cutting blade was vibrated with the frequency of 0.4 kHz in the direction perpendicular to the direction in which the honeycomb formed body moves, the amplitude (vertical amplitude) of 20 μm, the frequency of 10 kHz in the direction in parallel with the direction in which the honeycomb formed body moves, and the amplitude (back and forth amplitude) of less than 5 μm. A component of the moving speed of the cutting blade in the direction orthogonal to the direction in which the cells of the honeycomb formed body extend (moving speed component) was less than 150 mm/sec. The honeycomb formed body was cut in the vertical direction (in other words, in the direction orthogonal to the direction in which the cells of the honeycomb formed body extend). In Table 1, a "frequency in the direction perpendicular to the direction in which the honeycomb formed body moves" is indicated as a "frequency to vertical vibration" and a "frequency in the direction in parallel with the direction in which the honeycomb formed body moves" as a "frequency to back and forth vibration".

In the honeycomb formed body after cutting obtained as above, both end faces are faces orthogonal to the direction in which the cells extend, an outer shape is circular columnar, and diameters of the both end faces are 110 mm, respectively. In Table 1, regarding the term "double-supported/cantilever", the "double-supported" indicates that the cutting blade is a "double-supported cutting blade" and the "cantilever" indicates that the cutting blade is a "cantilever cutting blade".

For the honeycomb formed body after cutting, [cell crushing] and [durability] were evaluated as follows:

[Cell Crushing]

An end face of the honeycomb formed body after cutting was visually observed, and evaluation was made in accordance with the following standard. If the cutting blade could not enter the honeycomb formed body and could not cut the honeycomb formed body, it was evaluated as "impossible" (indicated as "1" in the table). If crush of the fourth or fifth cells counted from the outermost circumferential cell were confirmed, and moreover, the honeycomb formed body could not be cut continuously, it was evaluated as "possible" (indicated as "2" in the table). If crush of the second or third cells counted from the outermost circumferential cell were confirmed but the honeycomb formed body could be cut continuously, it was evaluated as "fair" (indicated as "3" in the table). If crush of the outermost circumferential cells were confirmed but the honeycomb formed body could be cut continuously, it was evaluated as "good" (indicated as "4" in the table). If crush of cells was not confirmed (that is, the cell of the honeycomb formed body was not deformed (that is, the partition walls in the end face of the honeycomb formed body were not deformed)) and moreover, the honeycomb formed body could be cut continuously, it was evaluated as "very good" (indicated as "5" in the table). The evaluation result is shown in Table 1.

[Durability]

A state of the cutting means (cutting blade, steel wire) when the honeycomb formed body was cut was observed, and an evaluation was made in accordance with the standard as follows: According to the cutting load in cutting, a state in which the honeycomb formed body was almost broken was evaluated as "impossible" (indicated as "1" in the table). If breakage occurred within 10 minutes after start of cutting, it was evaluated as "possible" (indicated as "2" in the table). If continuous use was possible until 12 hours after start of cutting but then, the honeycomb formed body was broken, it was evaluated as "fair" (indicated as "3" in the table). If continuous use was possible for 24 hours after start of cutting but then, the honeycomb formed body was broken, it was evaluated as "good" (indicated as "4" in the table). If continuous use was possible for more than 24 hours after start of cutting, it was evaluated as "very good" (indicated as "5" in the table). The evaluation result is shown in Table 1.

In Tables 1 and 2, the term "SKH" in a column for a material of the cutting blade is so-called high-speed tool steel and indicates that the cutting blade is made of a molybdenum-based material. The term "cemented" indicates that the cutting blade is made of tungsten-based cemented carbide. The term "SK" indicates that the cutting blade is carbon tool steel. The term "SUS without quenching" indicates that the cutting blade is stainless steel (SUS) having iron as a main component. The term "SUS with quenching" indicates that the cutting blade is quenched stainless steel.

TABLE 1

| | Cutting blade | | | | | | Vibration of cutting blade | | | |
|---|---|---|---|---|---|---|---|---|---|---|
| | Width (mm) | Thickness (mm) | Length (mm) | Material | Edge shape | Double-supported/cantilever | Excitation frequency (kHz) | Excitation output (W) | Vertical amplitude (μm) | Frequency to vertical vibration (kHz) |
| Comp. Ex. 1 | 18 | 0.5 | 300 | SKH | Double-edged | Double-supported | 0 | 0 | 0 | 0 |
| Ex. 1 | 18 | 0.5 | 300 | SKH | Double-edged | Double-supported | 0.4 | 10 | 20 | 0.4 |
| Ex. 2 | 18 | 0.5 | 300 | SKH | Double-edged | Double-supported | 10 | 90 | 25 | 10 |
| Ex. 3 | 18 | 0.5 | 300 | SKH | Double-edged | Double-supported | 20 | 25 | 5 | 20 |
| Ex. 4 | 18 | 0.5 | 300 | SKH | Double-edged | Double-supported | 20 | 50 | 10 | 20 |
| Ex. 5 | 18 | 0.5 | 300 | SKH | Double-edged | Double-supported | 20 | 75 | 20 | 20 |
| Ex. 6 | 18 | 0.5 | 300 | SKH | Double-edged | Double-supported | 20 | 100 | 25 | 20 |
| Ex. 7 | 18 | 0.5 | 300 | Cemented | Double-edged | Double-supported | 20 | 125 | 40 | 20 |

TABLE 1-continued

| | | | | | | | | | | |
|---|---|---|---|---|---|---|---|---|---|---|
| Ex. 8 | 18 | 0.5 | 300 | SKH | Double-edged | Double-supported | 20 | 250 | 20<br>100 | 20<br>0.4 |
| Ex. 9 | 18 | 0.5 | 300 | SKH | Double-edged | Double-supported | 25 | 100 | 25 | 25 |
| Ex. 10 | 18 | 0.5 | 300 | SKH | Double-edged | Double-supported | 40 | 100 | 25 | 40 |
| Ex. 11 | 18 | 0.5 | 300 | SKH | Double-edged | Double-supported | 20 | 75 | 20 | 20 |
| Ex. 12 | 18 | 0.5 | 300 | SKH | Double-edged | Double-supported | 20 | 100 | 25 | 20 |
| Ex. 13 | 18 | 0.5 | 300 | SKH | Double-edged | Double-supported | 20 | 125 | 40 | 20 |
| Ex. 14 | 18 | 0.5 | 300 | SKH | Double-edged | Double-supported | 20 | 150 | 25 | 20 |
| Ex. 15 | 18 | 0.5 | 300 | SKH | Double-edged | Double-supported | 20 | 250 | 20<br>100 | 20<br>0.5 |
| Ex. 16 | 18 | 0.15 | 300 | SKH | Double-edged | Double-supported | 20 | 50 | 10 | 20 |
| Ex. 17 | 18 | 0.15 | 300 | SKH | Double-edged | Double-supported | 20 | 60 | 15 | 20 |
| Ex. 18 | 18 | 0.15 | 300 | SKH | Double-edged | Double-supported | 20 | 100 | 20 | 20 |
| Ex. 19 | 18 | 0.15 | 300 | SKH | Double-edged | Double-supported | 20 | 150 | 20 | 20 |
| Ex. 20 | 5 | 0.25 | 300 | SKH | Double-edged | Double-supported | 20 | 60 | 15 | 20 |
| Ex. 21 | 5 | 0.25 | 300 | SKH | Double-edged | Double-supported | 20 | 60 | 20 | 20 |
| Ex. 22 | 30 | 0.25 | 300 | SKH | Double-edged | Double-supported | 20 | 60 | 15 | 20 |
| Ex. 23 | 18 | 0.25 | 300 | SKH | Double-edged | Double-supported | 20 | 50 | 10 | 20 |
| Ex. 24 | 18 | 0.25 | 300 | SKH | Double-edged | Double-supported | 20 | 60 | 15 | 20 |
| Ex. 25 | 18 | 0.25 | 300 | SKH | Double-edged | Double-supported | 20 | 75 | 20 | 20 |
| Ex. 26 | 18 | 0.25 | 300 | SKH | Double-edged | Double-supported | 20 | 150 | 20 | 20 |
| Ex. 27 | 18 | 0.7 | 300 | SKH | Double-edged | Double-supported | 20 | 75 | 20 | 20 |
| Ex. 28 | 18 | 0.7 | 300 | SKH | Double-edged | Double-supported | 20 | 100 | 25 | 20 |
| Ex. 29 | 18 | 0.7 | 300 | SKH | Double-edged | Double-supported | 20 | 150 | 30 | 20 |
| Ex. 30 | 18 | 0.7 | 300 | SKH | Double-edged | Double-supported | 20 | 175 | 30 | 20 |

| | Vibration of cutting blade | | | | | | | |
|---|---|---|---|---|---|---|---|---|
| | back and forth amplitude (μm) | Frequency to back and forth frequency (kHz) | Moving speed (mm/sec) | Partition wall thickness (μm) | Cell density (cells/cm$^2$) | Cell shape | Cell crushing | Dura-bility |
| Comp. Ex. 1 | 0 | 0 | <150 | 75 | 93 | Hexagonal | 1 | 1 |
| Ex. 1 | <5 | 10 | <150 | 75 | 93 | Hexagonal | 2 | 5 |
| Ex. 2 | <5 | 10 | <150 | 75 | 93 | Hexagonal | 4 | 5 |
| Ex. 3 | <5 | 20 | <150 | 75 | 93 | Hexagonal | 2 | 5 |
| Ex. 4 | <5 | 20 | <150 | 75 | 93 | Hexagonal | 2 | 5 |
| Ex. 5 | <5 | 20 | <150 | 75 | 93 | Hexagonal | 3 | 5 |
| Ex. 6 | <5 | 20 | <150 | 75 | 93 | Hexagonal | 4 | 5 |
| Ex. 7 | <5 | 20 | <150 | 75 | 93 | Hexagonal | 4 | 5 |
| Ex. 8 | 200 | 0.4 | <150 | 75 | 93 | Hexagonal | 5 | 2 |
| Ex. 9 | <5 | 25 | <150 | 75 | 93 | Hexagonal | 4 | 5 |
| Ex. 10 | <5 | 40 | <150 | 75 | 93 | Hexagonal | 4 | 2 |
| Ex. 11 | <5 | 20 | <150 | 50 | 354 | Square | 2 | 5 |
| Ex. 12 | <5 | 20 | <150 | 50 | 354 | Square | 2 | 5 |
| Ex. 13 | <5 | 20 | <150 | 50 | 354 | Square | 2 | 5 |
| Ex. 14 | 50 | 10 | <150 | 50 | 354 | Square | 5 | 3 |
| Ex. 15 | 200 | 0.4 | <150 | 50 | 354 | Square | 5 | 2 |
| Ex. 16 | <5 | 20 | <150 | 75 | 93 | Hexagonal | 4 | 5 |
| Ex. 17 | <5 | 20 | <150 | 75 | 93 | Hexagonal | 4 | 2 |
| Ex. 18 | <5 | 20 | <150 | 75 | 93 | Hexagonal | 5 | 2 |
| Ex. 19 | 100 | 20 | <150 | 75 | 93 | Hexagonal | 5 | 2 |
| Ex. 20 | <5 | 20 | <150 | 75 | 93 | Hexagonal | 4 | 5 |
| Ex. 21 | <5 | 20 | <150 | 75 | 93 | Hexagonal | 5 | 5 |
| Ex. 22 | <5 | 20 | <150 | 75 | 93 | Hexagonal | 3 | 5 |
| Ex. 23 | <5 | 20 | <150 | 75 | 93 | Hexagonal | 2 | 5 |
| Ex. 24 | <5 | 20 | <150 | 75 | 93 | Hexagonal | 4 | 5 |

TABLE 1-continued

| | | | | | | | | |
|---|---|---|---|---|---|---|---|---|
| Ex. 25 | <5 | 20 | <150 | 75 | 93 | Hexagonal | 5 | 5 |
| Ex. 26 | 100 | 0.4 | <150 | 75 | 93 | Hexagonal | 5 | 2 |
| Ex. 27 | <5 | 20 | <150 | 75 | 93 | Hexagonal | 2 | 5 |
| Ex. 28 | <5 | 20 | <150 | 75 | 93 | Hexagonal | 2 | 5 |
| Ex. 29 | <5 | 20 | <150 | 75 | 93 | Hexagonal | 2 | 5 |
| Ex. 30 | 100 | 0.4 | <150 | 75 | 93 | Hexagonal | 2 | 5 |

TABLE 2

| | Cutting blade | | | | | | Vibration of cutting blade | | | |
|---|---|---|---|---|---|---|---|---|---|---|
| | Width (mm) | Thickness (mm) | Length (mm) | Material | Edge shape | Double-supported/ cantilever | Excitation frequency (kHz) | Excitation output (W) | Vertical amplitude (μm) | Frequency to vertical vibration (kHz) |
| Ex. 31 | 18 | 0.9 | 300 | SKH | Double-edged | Double-supported | 20 | 75 | 20 | 20 |
| Ex. 32 | 18 | 0.9 | 300 | SKH | Double-edged | Double-supported | 20 | 100 | 25 | 20 |
| Ex. 33 | 18 | 0.9 | 300 | SKH | Double-edged | Double-supported | 20 | 150 | 30 | 20 |
| Ex. 34 | 18 | 0.9 | 300 | SKH | Double-edged | Double-supported | 20 | 175 | 25 | 20 |
| Ex. 35 | 16 | 0.5 | 300 | SKH | Double-edged | Double-supported | 20 | 75 | 20 | 20 |
| Ex. 36 | 16 | 0.5 | 300 | SKH | Double-edged | Double-supported | 20 | 100 | 25 | 20 |
| Ex. 37 | 16 | 0.5 | 300 | SKH | Double-edged | Double-supported | 20 | 125 | 40 | 20 |
| Ex. 38 | 16 | 0.5 | 300 | SKH | Double-edged | Double-supported | 20 | 250 | 20<br>100 | 20<br>0.5 |
| Ex. 39 | 18 | 0.5 | 300 | SK | Double-edged | Double-supported | 20 | 75 | 20 | 20 |
| Ex. 40 | 18 | 0.5 | 300 | SK | Double-edged | Double-supported | 20 | 100 | 25 | 20 |
| Ex. 41 | 18 | 0.5 | 300 | SK | Double-edged | Double-supported | 20 | 175 | 25 | 20 |
| Ex. 42 | 18 | 0.5 | 300 | SUS with quenching | Double-edged | Double-supported | 20 | 75 | 20 | 20 |
| Ex. 43 | 18 | 0.5 | 300 | SUS with quenching | Double-edged | Double-supported | 20 | 100 | 25 | 20 |
| Ex. 44 | 18 | 0.5 | 300 | SUS with quenching | Double-edged | Double-supported | 20 | 175 | 25 | 20 |
| Ex. 45 | 12 | 0.5 | 300 | SUS without quenching | Double-edged | Double-supported | 20 | 50 | 10 | 20 |
| Ex. 46 | 12 | 0.5 | 300 | SUS without quenching | Double-edged | Double-supported | 20 | 75 | 20 | 20 |
| Ex. 47 | 18 | 0.5 | 300 | SKH | Single-edged | Double-supported | 20 | 100 | 25 | 20 |
| Ex. 48 | 18 | 0.5 | 300 | SKH | Single-edged | Double-supported | 20 | 175 | 25 | 20 |
| Ex. 49 | 18 | 0.5 | 300 | SKH | Saw blade | Double-supported | 20 | 100 | 25 | 20 |
| Ex. 50 | 18 | 0.5 | 300 | SKH | Double-edged | Cantilever | 20 | 100 | 25 | 20 |
| Ex. 51 | 18 | 0.5 | 300 | SKH | Double-edged | Cantilever | 20 | 100 | 25 | 20 |
| Ex. 52 | 18 | 0.5 | 300 | SKH | Double-edged | Cantilever | 20 | 150 | 25 | 20 |
| Ex. 53 | 18 | 0.15 | 300 | SKH | Double-edged | Cantilever | 20 | 50 | 10 | 20 |
| Ex. 54 | 18 | 0.15 | 300 | SKH | Double-edged | Cantilever | 20 | 200 | 25 | 20 |
| Ex. 55 | 18 | 0.25 | 300 | SKH | Double-edged | Cantilever | 20 | 50 | 10 | 20 |
| Ex. 56 | 18 | 0.25 | 300 | SKH | Double-edged | Cantilever | 20 | 60 | 15 | 20 |
| Ex. 57 | 18 | 0.25 | 300 | SKH | Double-edged | Cantilever | 20 | 175 | 25 | 20 |
| Comp. Ex. 2 | Wire diameter φ100 | | 300 | Carbon steel material | Double-supported | Double-supported | 0 | 0 | 0 | 0 |

TABLE 2-continued

| | | | | | | | | | |
|---|---|---|---|---|---|---|---|---|---|
| Comp. Ex. 3 | Wire diameter ϕ100 | 300 | Carbon steel material | Double-supported | Double-supported | 40 | 25 | 5 | 40 |
| Comp. Ex. 4 | Wire diameter ϕ300 | 300 | Carbon steel material | Double-supported | Double-supported | 20 | 50 | 10 | 20 |
| Comp. Ex. 5 | Wire diameter ϕ300 | 300 | Carbon steel material | Double-supported | Double-supported | 20 | 75 | 20 | 20 |

| | Vibration of cutting blade | | | | | | | |
|---|---|---|---|---|---|---|---|---|
| | back and forth amplitude (μm) | Frequency to back and forth frequency (kHz) | Moving speed (mm/sec) | Partition wall thickness (μm) | Cell density (cells/cm$^2$) | Cell shape | Cell crushing | Durability |
| Ex. 31 | <5 | 20 | <150 | 75 | 93 | Hexagonal | 2 | 5 |
| Ex. 32 | <5 | 20 | <150 | 75 | 93 | Hexagonal | 2 | 5 |
| Ex. 33 | <5 | 20 | <150 | 75 | 93 | Hexagonal | 2 | 5 |
| Ex. 34 | 100 | 0.4 | <150 | 75 | 93 | Hexagonal | 2 | 5 |
| Ex. 35 | <5 | 20 | <150 | 75 | 93 | Hexagonal | 3 | 5 |
| Ex. 36 | <5 | 20 | <150 | 75 | 93 | Hexagonal | 4 | 5 |
| Ex. 37 | <5 | 20 | <150 | 75 | 93 | Hexagonal | 4 | 5 |
| Ex. 38 | 200 | 0.4 | <150 | 75 | 93 | Hexagonal | 5 | 2 |
| Ex. 39 | <5 | 20 | <150 | 75 | 93 | Hexagonal | 3 | 5 |
| Ex. 40 | <5 | 20 | <150 | 75 | 93 | Hexagonal | 4 | 5 |
| Ex. 41 | 100 | 0.4 | <150 | 75 | 93 | Hexagonal | 5 | 2 |
| Ex. 42 | <5 | 20 | <150 | 75 | 93 | Square | 3 | 5 |
| Ex. 43 | <5 | 20 | <150 | 75 | 93 | Square | 4 | 5 |
| Ex. 44 | 100 | 0.4 | <150 | 75 | 93 | Square | 5 | 2 |
| Ex. 45 | <5 | 20 | <150 | 75 | 93 | Square | 2 | 2 |
| Ex. 46 | <5 | 20 | <150 | 75 | 93 | Square | 4 | 2 |
| Ex. 47 | <5 | 20 | <150 | 75 | 93 | Square | 3 | 5 |
| Ex. 48 | 100 | 0.4 | <150 | 75 | 93 | Square | 4 | 2 |
| Ex. 49 | <5 | 20 | <150 | 75 | 93 | Square | 2 | 5 |
| Ex. 50 | <5 | 20 | <150 | 75 | 93 | Square | 4 | 5 |
| Ex. 51 | <5 | 20 | <150 | 50 | 354 | Square | 2 | 2 |
| Ex. 52 | 50 | 10 | <150 | 50 | 354 | Square | 5 | 2 |
| Ex. 53 | <5 | 20 | <150 | 50 | 354 | Square | 2 | 2 |
| Ex. 54 | 100 | 0.4 | <150 | 50 | 354 | Square | 2 | 2 |
| Ex. 55 | <5 | 20 | <150 | 50 | 354 | Square | 2 | 2 |
| Ex. 56 | <5 | 20 | <150 | 50 | 354 | Square | 4 | 2 |
| Ex. 57 | 100 | 0.4 | <150 | 50 | 354 | Square | 4 | 2 |
| Comp. Ex. 2 | 0 | 0 | <150 | 75 | 93 | Square | 1 | 1 |
| Comp. Ex. 3 | — | — | <150 | 75 | 93 | Square | 1 | 1 |
| Comp. Ex. 4 | — | — | <150 | 75 | 93 | Square | 1 | 1 |
| Comp. Ex. 5 | — | — | <150 | 75 | 93 | Square | 1 | 1 |

Examples 2 to 57

By using the cutting blade and the honeycomb formed body shown in Tables 1 and 2, the honeycomb formed body was cut similarly to Example 1 except that the cutting blade was vibrated under the conditions shown in Tables 1 and 2. Subsequently, for the honeycomb formed body cut product, [cell crushing] and [durability] were evaluated similarly to Example 1. The evaluation results are shown in Tables 1 and 2.

In Example in which two numerical values are described in the columns of the "vertical amplitude" and the "frequency (kHz) to the vertical amplitude" in Tables 1 and 2, these numerical values indicate primary vibration and secondary vibration. Then, the numerical values described in the upper side of the column are for the primary vibration, and the numerical values described in the lower side of the column are for the secondary vibration. That is, it indicates a state (state in which main large waves vibrate further finely) that the cutting blade vibrates in a state where waves with a small wavelength ride on waves with a large wavelength of the primary vibration (making secondary vibration).

Comparative Example 1

By using the cutting blade and the honeycomb formed body shown in Table 1, the honeycomb formed body was cut similarly to Example 1 except that the cutting blade was not vibrated. Subsequently, for the honeycomb formed body cut product, [cell crushing] and [durability] were evaluated similarly to Example 1. The evaluation result is shown in Table 1.

Comparative Examples 2 to 5

The honeycomb formed body was cut similarly to Example 1 except that the steel wire (made of carbon steel) is used instead of the cutting blade. Diameters of used steel wires (wire diameter (μm)) are shown in Table 2. Subsequently, for the honeycomb formed body cut product, [cell crushing] and [durability] were evaluated similarly to Example 1. The evaluation result is shown in Table 2. In Comparative Examples 2 to 5, an operation of making a cut line in which the steel wire is made to enter in a direction orthogonal to the direction in which the cells extend by using a knife-shape tool in advance in a portion of the honeycomb formed body in which cutting is to be started is not performed.

From the results of Examples 1 to 57 and Comparative Examples 1 to 57, according to the cutting methods of a honeycomb formed body in Examples 1 to 57, it was confirmed that the shape of the cells in the end face of the honeycomb formed body after cutting were made more favorable than the cutting methods of a honeycomb formed body in Comparative Examples 1 to 5. Moreover, in the cutting method of a honeycomb formed body in Examples 1 to 57, it was confirmed that durability of the cutting blade was favorable, and the honeycomb formed body after cutting could be obtained efficiently.

INDUSTRIAL APPLICABILITY

The cutting method of a honeycomb formed body of the present invention can be employed for a process of fabricating a carrier (honeycomb formed body) having a honeycomb shape carrying a catalyst for purifying an exhaust gas exhausted from an engine of an automobile or the like.

DESCRIPTION OF REFERENCE NUMERALS

2 cell
5 partition wall
10 cutting blade
12 cutting portion body
14 first support member
16 second support member
20 honeycomb formed body
100, 101 cutting device
X horizontal direction
Y direction orthogonal to direction in which cells extend

The invention claimed is:

1. A cutting method of a honeycomb formed body, wherein, while a kneaded material containing a ceramic raw material is extruded to form a honeycomb formed body having partition walls defining and forming a plurality of cells and having a honeycomb shape, the extruded honeycomb formed body is cut before drying by a single cutting blade vibrated at a frequency of 0.3 kHz or more in a direction perpendicular to a direction in which the honeycomb formed body moves, wherein an extrusion speed of the honeycomb formed body and a component of the moving speed of the cutting blade in a direction in parallel with a direction in which the cells of the honeycomb formed body extend are equal.

2. The cutting method of a honeycomb formed body according to claim 1, wherein the cutting blade is vibrated at a high frequency of 10 kHz or more.

3. The cutting method of a honeycomb formed body according to claim 1, wherein the cutting blade is vibrated with amplitude of vibration at 15 to 40 μm in the direction perpendicular to the direction in which the honeycomb formed body moves.

4. The cutting method of a honeycomb formed body according to claim 1, wherein a thickness of the cutting blade is 0.6 mm or less.

5. The cutting method of a honeycomb formed body according to claim 1, wherein vertical vibration which is vibration in the direction perpendicular to the direction in which the honeycomb formed body moves, and lateral vibration which is vibration in a direction in parallel with the direction in which the honeycomb formed body moves are included; and the cutting blade is vibrated with amplitude of the lateral vibration at 30 μm or more.

6. The cutting method of a honeycomb formed body according to claim 1, wherein a width of the cutting blade is 5 to 30 mm.

7. The cutting method of a honeycomb formed body according to claim 1, wherein the cutting blade is vibrated at an output of 50 W or more.

8. The cutting method of a honeycomb formed body according to claim 1, wherein while the kneaded material is extruded in a horizontal direction to form the honeycomb formed body, the extruded honeycomb formed body is cut so that a section in a direction orthogonal to the direction in which the cells of the honeycomb formed body extend is formed by the cutting blade.

9. The cutting method of a honeycomb formed body according to claim 1, wherein a component of a moving speed of the cutting blade in a direction orthogonal to the direction in which the cells of the honeycomb formed body extend is 10 to 100 mm/second.

10. The cutting method of a honeycomb formed body according to claim 1, wherein a thickness of the partition walls of the honeycomb formed body is 50 to 300 μm.

11. The cutting method of a honeycomb formed body according to claim 1, wherein as the cutting blade, a cutting blade of a material of stainless steel, quenched stainless steel or carbon steel is used.

12. The cutting method of a honeycomb formed body according to claim 1, wherein the cutting blade has two end portions that are supported by a support member connected to a vibrator generating vibration at a frequency of 0.3 kHz or more.

* * * * *